US007204920B2

(12) United States Patent
Kwak et al.

(10) Patent No.: US 7,204,920 B2
(45) Date of Patent: Apr. 17, 2007

(54) CONTACT RING DESIGN FOR REDUCING BUBBLE AND ELECTROLYTE EFFECTS DURING ELECTROCHEMICAL PLATING IN MANUFACTURING

(75) Inventors: Byung-Sung Leo Kwak, Portland, OR (US); Gregory Frank Piatt, Welches, OR (US); Hiroshi Mizuno, Gresham, OR (US)

(73) Assignee: LSI Logic Corporation, Milpitas, CA (US)

( * ) Notice: Subject to any disclaimer, the term of this patent is extended or adjusted under 35 U.S.C. 154(b) by 341 days.

(21) Appl. No.: 10/973,851

(22) Filed: Oct. 25, 2004

(65) Prior Publication Data

US 2006/0086608 A1 Apr. 27, 2006

(51) Int. Cl.
*B23H 3/04* (2006.01)

(52) U.S. Cl. ..... 204/286.1; 204/287; 204/297.01; 204/297.06; 204/297.08; 204/279

(58) Field of Classification Search ..... 204/279, 204/286.1, 287, 297.01, 297.06, 297.08; 205/137, 143, 152, 157, 220
See application file for complete search history.

(56) References Cited

U.S. PATENT DOCUMENTS 5,437,777 A * 8/1995 Kishi ..... 204/224 R
6,398,926 B1 * 6/2002 Mahneke ..... 204/224 R

* cited by examiner

*Primary Examiner*—Bruce F. Bell
(74) *Attorney, Agent, or Firm*—Beyer Weaver & Thomas, LLP

(57) ABSTRACT

A contact ring for use in electroplating of a substrate material is constructed such that fluid (e.g., electrolyte) is allowed to flow radially away from the axis of a toroidal support ring, thus preventing the trapping of fluids between the substrate and the toroidal support ring. The contact ring is constructed with a series of openings arranged about the circumference of the ring and wherein an electrical contact is placed in the path of each opening so any fluid passing through the opening also passes around the associated electrical contact. Further, the electrical contacts are also placed such that a substrate (e.g., a semiconductor wafer) can be placed inside the support ring so as to electrically contact the electrical contacts. The toroidal support ring has an aerodynamically streamlined cross-section at the openings, such that fluid flows through the openings with reduced aerodynamic drag.

22 Claims, 6 Drawing Sheets

CONTACT RING DESIGN FOR REDUCING BUBBLE AND ELECTROLYTE EFFECTS DURING ELECTROCHEMICAL PLATING IN MANUFACTURING

BACKGROUND OF THE INVENTION

1. Field of the Invention

The present invention relates to electrochemical plating systems, and specifically addresses improvements over conventional "contact ring" designs.

2. Description of the Related Art

Copper has taken on a significant role in semiconductor integrated circuit (IC) manufacturing because of its low resistivity and the potential for improved electromigration (EM) performance as compared to aluminum. The current standard for copper metallization is electrochemical plating. One typical apparatus used in electroplating operations is a "contact ring". However, current contact ring designs are not suitable for all applications.

In conventional IC manufacturing processes, the apparatus used to electroplate material onto a substrate typically includes a plating cell 100 as shown in FIG. 1, which is a schematic diagram of a side view of a typical "fountain" type electroplating cell. FIG. 1 shows a support arm 101, which holds a semiconductor substrate 103 in a contact ring (not shown). Substrate 103 is placed face down on the contact ring and electrically connected to a power supply (not shown) via electrical contacts on the contact ring. The substrate 103 is then immersed in an electrolyte 107 for plating. Electroplating occurs primarily on the downward facing surface of the substrate 103. FIG. 1 shows position A (before pivoting), where the substrate 103 is not immersed in the electrolyte 107, and position B (after pivoting), where the substrate is immersed in electrolyte 107. Typically, support arm 101 is used to immerse substrate 103 using a pendulum like motion, where the angled entry of the substrate into the electrolyte serves to minimize the formation of bubbles on the surface of the substrate during immersion. Generally, support arm 101 is also capable of rotating along its longitudinal axis and periodically raising and lowering, so as to improve plating uniformity during electroplating. Plating cell housing 109 contains the flow of electrolyte 107, which flows upward, like a fountain, while the substrate 103, on which the metallization is to take place, is immersed in the electrolyte 107.

A contact ring, as described above, provides mechanical support for a substrate and electrical contacts which connect the substrate to a power supply in order to enable electroplating operations. FIGS. 2(*a*) and 2(*b*) are schematic representations of a typical "wet" contact ring design 200. Typically, in this design, the contact ring and the substrate it supports are fully immersed an electrolyte during electroplating. FIG. 2(*a*) is a cross-sectional view showing a semiconductor substrate 205 resting on a contact 201 supported by a toroidal contact ring base 203. The substrate 205 is held in place by a clamping device (not shown), such as a backside clamp. FIG. 2(*b*) is a radial view corresponding to the cross-sectional view in FIG. 2(*a*). Electroplating occurs on the bottom surface 207 of the substrate 205. Note that this design incorporates a very small gap 208 between the bottom surface 207 of substrate 205 and the upper surface of the toroidal contact ring base 203, which makes the trapping of bubbles during the immersion process quite likely, resulting in bubble defects, plating depressions, and plating swirl due to the inhibition of plating underneath the trapped bubbles. Bubble defects occur in areas where a large potential gap between the electrolyte and a wafer surface is created by bubbles in the electrolyte, inhibiting the plating reaction and leading to the formation of no plating zones. Moreover, since the wafer is rotating, bubbles that form will often spiral out away from the point of formation, leaving swirl-shaped plating defects.

FIGS. 2(*c*) and 2(*d*) show schematic representations of a conventional "dry" contact ring design 250. In this design, FIG. 2(*c*) is a cross-sectional view showing a semiconductor substrate 255 resting on a contact 251 supported by a toroidal contact ring base 253. As in FIGS. 2(*a*) and 2(*b*) above, a clamping device (not shown), such as a backside clamp, is used to hold the substrate 255 in place. FIG. 2(*d*) is a radial view corresponding to the cross-sectional view in FIG. 2(*c*). Additionally, the dry contact ring design 250 incorporates a barrier 257 in order to isolate electrical contacts 251 from the electrolyte. Note, that in a dry contact ring design 250, only the bottom surface 259 of the substrate 255 comes in contact with the electrolyte.

The advantage of a dry contact ring design is that the electrical contacts are protected from the harsh conditions in the electrolyte during plating operations. However, the dry contact ring design actually worsens the problem of bubble trapping when compared to the wet contact ring design because there is no place for trapped bubbles to escape once they have been formed. One additional issue with using the dry contact ring design is that boundary conditions near the barrier 257 cause a localized increased thickness of electroplated material to be formed. This increased thickness at the edges of the electroplated material on the substrate results in a spike-like profile, similar to that illustrated in FIG. 3, which graphs a thickness profile across the diameter of a semiconductor wafer, illustrating the impact of stagnation points due to fluid boundary conditions.

The spikes in thickness have a significant impact during chemical mechanical polishing (CMP) and can result in Cu residues at the edge of the substrate. In order to remove the spikes at the edge of the electroplated material, the material must be over-polished, leading to increased erosion (sheet ρ variation) at the wafer center.

FIGS. 2(*e*) and 2(*f*) show schematic representations of a yet another conventional wet contact ring design 275 where the individual electrical contacts 277 are fully exposed to the electrolyte. In this design, each contact 277 is located on a separate support arm 279. A plurality of support arms 279 replace the toroidal ring structure (as illustrated in FIGS. 2(*a*)–2(*d*)). As in the other designs discussed above, a substrate 281 rests on contacts 277 and is held in place by clamping means (not shown). Although replacing the toroidal contact ring base with a plurality of support arms 279 addresses to some extent the bubble trap issue, new concerns arise due to the design differences. A first concern is that the robust electrical contact required for uniform distribution of current during electroplating may be hard to achieve due to the relatively weak support structure provided by individual support arms 279. A second concern is that the electrical contacts 277 must withstand greater exposure to the high acidity of the electroplating solution as well as high current/potential. The additional stress and voltage tolerance requirements induce a need for more expensive materials. On the other hand, if cheaper materials are to be used, then new methods and chemistries must be developed to protect the supports and contacts, for example, implementing a deionized (DI) water cleaning system to rinse the contact ring and substrate after plating. However, implementing new methods results in additional hardware/control requirements as well as, potentially, a loss in throughput due to additional processing time.

On a side note, when using a dry contact ring, such as those discussed above in reference to FIGS. 2(*c*) and 2(*d*), a post-plating DI rinse is required before the wafer is removed from the wet section of the apparatus, because the electrolyte, if allowed to enter the dry portion of the plating chamber, will result in corrosion of components and create defects in the plated material due to corrosion particles and precipitation of inorganic salts from the electrolyte.

Another common problem that occurs with conventional contact ring designs is that of "trapped" residual electrolyte, which occurs when wafers are electroplated in succession. Typically, when the wafer is removed from the contact ring after electroplating, the contact ring undergoes a "deplating" process (for wet contacts) in order to clean the electrical contacts prior to receiving the next wafer. If any residual electrolyte is left on the contact ring, "scalloping defects" (i.e., areas with a local thickness that is greater than that of surrounding areas and the overall plated thickness across a wafer) can occur. This is so because the residual electrolyte on the contact ring becomes a source of Cu for local plating, as the current/voltage bias is applied to the wafers before entering the electrolyte. Such electroplated defects can lead to topography differences, resulting in erosion and dishing defects after CMP has been completed. FIG. 4(*a*) is a photograph of a "scalloping" defect, while FIG. 4(*b*) shows an atomic force microscopy (AFM) scan across the defect, illustrating the ridge visible in the photograph. The black line visible in FIG. 4(*a*) shows the path traced by the AFM, while the brackets shown in the figures correlate the two figures.

A second, related problem occurs during the transfer stages after plating has been completed. Once the plating is done, the contact ring and wafer are lifted out of the electrolyte and dried by rotating the assembly for a fixed amount of time. In wet contact ring designs incorporating the features shown in FIGS. 2(*a*) and 2(*b*), the low clearance between the substrate 205 and the top surface of the toroidal contact ring base 203 causes the electrolyte to concentrate in the gap if the rotation speed is too slow. Residual electrolyte on the contact ring and on the wafer edge causes "electrolyte induced staining", where the electrolyte significantly oxidizes the surface of the wafer when the assembly is exposed to air during the transfer from the plating cell to subsequent modules. Electrolyte induced staining can result in erosion and dishing defects (similar to those caused by scalloping defects, discussed above) after CMP has been completed.

The foregoing discussion addresses some limitations of conventional contact ring designs, the use of which can result in potentially yield-impacting defects. For these and other reasons, there is a need for new types of contact rings that can reduce the occurrence of the defects discussed above as well as other defects.

SUMMARY OF THE INVENTION

To achieve the foregoing, the present invention provides contact ring designs and implementations configured to reduce the incidence of electroplating induced defects. Embodiments of the invention can be implemented in numerous ways, including as methods, systems, devices, or apparatus. Several embodiments of the invention are discussed below.

According to one embodiment of the invention, a contact ring for use in electroplating of a substrate material is constructed such that fluid (e.g., electrolyte) is allowed to flow radially away from the axis of the contact ring, thus preventing the trapping of fluids between the substrate and the contact ring. The contact ring is constructed such that a series of openings are arranged about the circumference of the ring, and an electrical contact is placed in the path of each opening so any fluid passing through the opening must also pass around the associated electrical contact. Further, the electrical contacts are also placed such that a substrate (e.g., a semiconductor wafer) can be placed inside the support ring so as to electrically contact the electrical contacts. According to some embodiments, the contact ring has an aerodynamically streamlined cross-section at the openings to improve fluid flow at the openings. In one embodiment of the invention, the cross-sectional shape of at least one of the flow surfaces of the opening is shaped like a wing.

In a second embodiment of the invention, a toroidal contact ring including a contact ring base and a support ring mounted on top of and integral to the ring base is configured to improve drainage and fluid flow. The contact ring base has sloped sides, which aid in drainage of electrolyte from the top surface of the contact ring base. The support ring has a series of openings arranged along the circumference of the support ring such that each opening runs radially from the inner edge of the ring to the outer edge of the ring, enabling fluid flow from the inner edge of the support ring to the outer edge of the support ring. Electrodes are arranged in the path of the openings around the contact ring base to support and electrically contact a substrate (e.g., a semiconductor wafer), which has been placed over the top of the support ring. Each of the openings has at least one flow surface that is aerodynamically streamlined to improve flow across the surface. In one embodiment of the invention, the cross-sectional shape of the aerodynamically shaped flow surfaces in each opening is shaped like a wing. Other shapes, such as elliptical, hyperbolic, or triangular cross-sections are possible as well so as to minimize the trapping of fluids between the substrate and the toroidal contact ring.

BRIEF DESCRIPTION OF THE DRAWINGS

The invention will be readily understood by the following detailed description in conjunction with the accompanying drawings in which:

FIG. 6(*e*) is a drawing of a contact ring according to a second embodiment of the invention.

It is to be understood that in the drawings like reference numerals designate like structural elements. Also, it is understood that the depictions in the Figures are not necessarily to scale.

DETAILED DESCRIPTION OF THE INVENTION

The invention pertains to an improved contact ring for use in electroplating a semiconductor substrate material (e.g., a semiconductor wafer). Specifically, the principles of the present invention are directed to improved contact ring designs and methods in order to minimize or eliminate common plating defects while maintaining the contact ring's structural strength and chemical resistance.

In the discussion above, several common problems with current contact rings were discussed. The solutions detailed in this various embodiments of the present invention generally address these problems. Some embodiments of the invention address improvements to fluid flow near the electrical contacts. One specific embodiment is shown in FIGS. 5(*a*)–5(*d*) and 6(*a*)–6(*e*).

In general, a contact ring according to various embodiments of the invention incorporates a number of changes from older designs. In one embodiment, openings are formed along the circumference of the contact ring. These openings are configured to allow the easy egress of air or electrolyte away from the substrate or contact ring. Such configurations reduce the formation of air bubbles and electrolyte build up by allowing air or electrolytes reaching the openings, either during immersion or during plating, to easily escape away from the substrate surface. Embodiments of the invention include an increased protrusion height for the contact on the toroidal contact ring base. This permits a larger gap between a substrate and the contact ring base facilitating the flow of air through and out of the substrate area during immersion and plating. Other embodiments of the invention can be configured with an aerodynamically streamlined shape if desired. In some embodiments the aerodynamically streamlined shape can be used to reduce turbulence during fluid (air and electrolyte) flow. Moreover, such shaping can be configured to improve drainage of electrolytes during drying stages. These features reduce the "degree of stagnation" (e.g., the abruptness of boundary conditions), which has heretofore resulted in reduced local plating non-uniformity caused generally by significantly higher plating rates near stagnation points. Another benefit of these features is that splashing during immersion is reduced, which can reduce the incidence of immersion (dot-line) void defects. Note that, in the context of this application, aerodynamically streamlined is defined as a configuration arranged to reduce the aerodynamic drag on the shaped surface. Furthermore, as used herein, aerodynamically streamlined is taken to include hydrodynamically streamlined shapes (i.e., shapes that reduces the hydrodynamic drag and improves the flow of a fluid over-the surface of the streamlined shape).

Figure 5B:
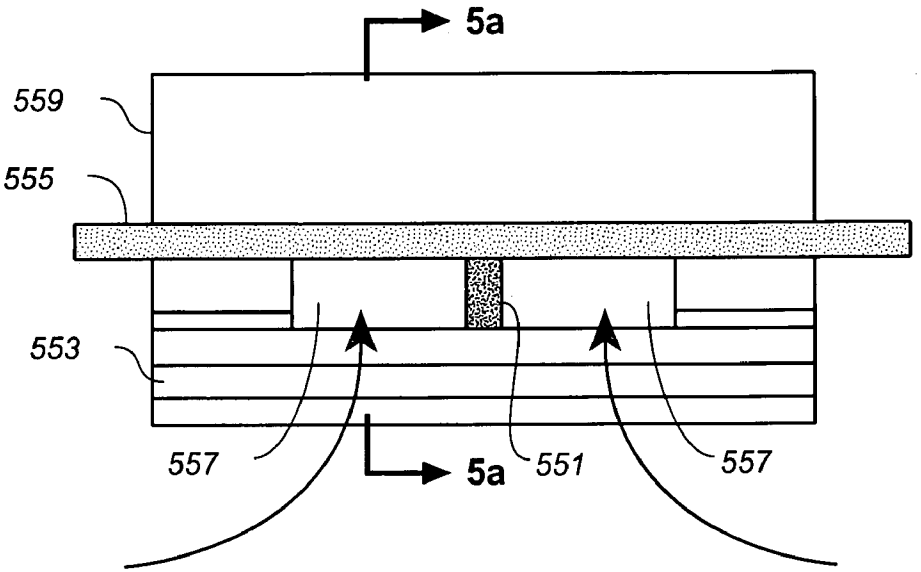
FIGS. 5(*a*) and 5(*b*) are simplified schematic representations of a contact ring according to one embodiment of the present invention.
Figure 5A:
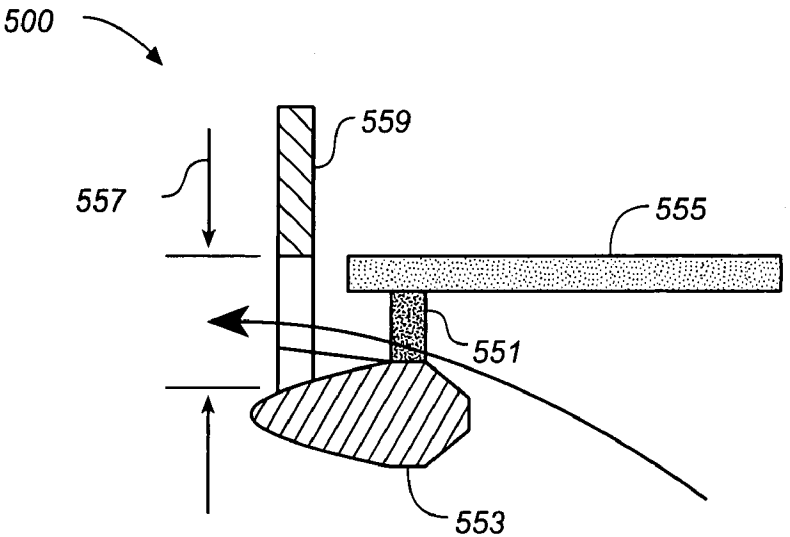
Figure 6A:
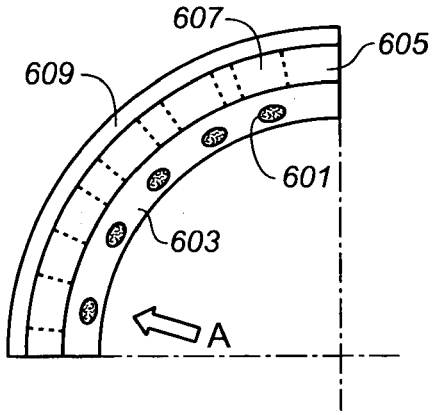
FIGS. 6(*a*)–6(*d*) are drawings of a contact ring according to one embodiment of the present invention.
Figure 6B:
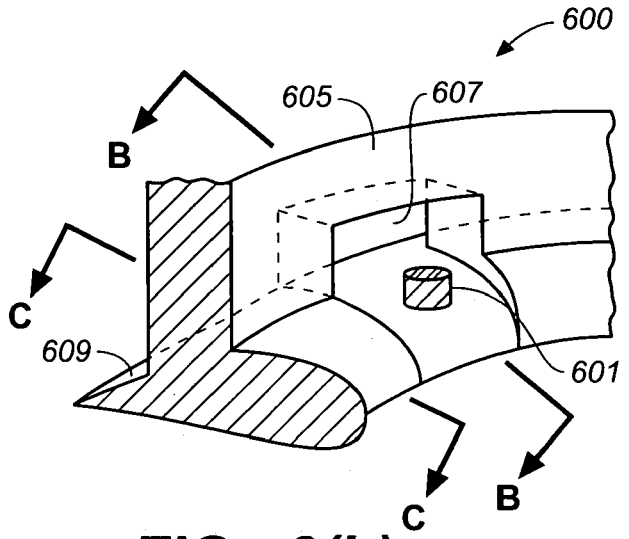
Figure 6C:
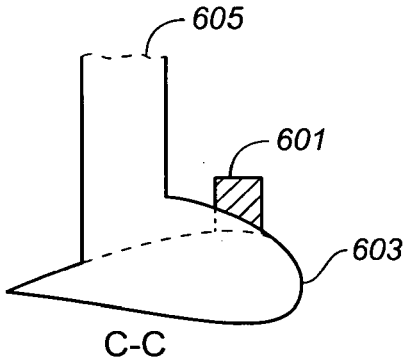
Figure 6D:
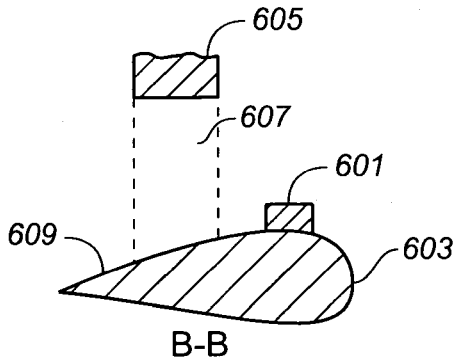
Figure 6E:
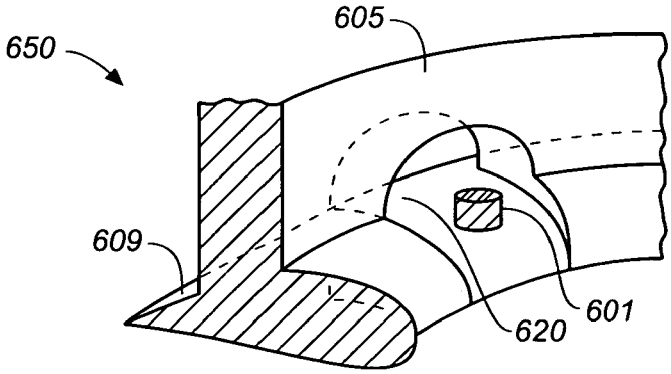

FIGS. 5(*a*) and 5(*b*) are simplified schematic representations of a contact ring assembly 500 according to one embodiment of the present invention. FIG. 5(*a*) is a cross-sectional view showing a semiconductor substrate 555 resting on a contact 551 supported by a toroidal contact ring base 553. A clamping device (not shown), such as a backside clamp, is used to hold the substrate 555 in place. Toroidal support structure 559 is generally arranged in contact with the contact ring base 553, providing additional support for the contact ring assembly 500 as well as providing one or more contact points (not shown), which are used to attach a support arm (not shown in this view). The support arm (not shown) is used to move the substrate around in the electroplating environment and may be similar to support arm 101 shown in above in FIG. 1. FIG. 5(*b*) is a simplified radial view corresponding to the cross-sectional view in FIG. 5(*a*), showing substrate 555 resting on contact 551, supported by toroidal contact ring base 553 and connected to support arm (not shown) by toroidal support structure 559.

Additionally, this design 500 incorporates a plurality of openings 557 arranged along the circumference of toroidal support structure 559. Flow arrows are shown, indicating general paths that fluid might take through openings 557 during electroplating operations.

FIGS. 6(*a*)–6(*d*) are cutaway drawings of a portion of a contact ring 600 according to another embodiment of the present invention. FIG. 6(*a*) is a simplified top view of a portion of a contact ring 600, showing contact electrodes 601 supported by toroidal contact ring base 603. Toroidal support structure 605 is also shown with openings 607 indicated by dashed lines extending radially through the structure. Outer lip 609 (discussed below) extends around the circumference of contact ring 600. FIG. 6(*b*) is an isometric view of contact ring 600 (viewed from point A shown on FIG. 6(*a*) showing a contact electrode 601, supported by toroidal contact ring base 603. Toroidal support structure 605 is also shown with openings 607. Outer lip 609 is also shown. Further, cutaway lines B—B and C—C are indicated.

FIG. 6(*c*) is a cutaway view of a cross-section of contact ring 600 along a C—C cross-section line shown above in FIG. 6(*b*). Contact electrode 601 is shown supported by toroidal contact ring base 603. When viewed along the C—C cross-section, toroidal support structure 605 surrounds openings 607. The cross-section C—C clearly depicts the aerodynamically streamlined shape of the contact ring base 603. The view in FIG. 6(*c*) indicates that toroidal contact ring base 603 has a 'wing shaped' cross-section along the C—C cross-section. According to one embodiment of the invention, the aerodynamically streamlined shape of the C—C cross-section is chosen to allow aerodynamic flow of gas (e.g., bubbles) and fluid (e.g., electroplating solution) around or through the contact ring during immersion and electroplating steps. Cross-section C—C may be any shape that allows for improved radial fluid flow through the contact ring assembly. Examples of suitable cross-sectional shapes include, but are not limited to, various wing, rectangular, elliptical, or hyperbolic cross-sections. The inventors further contemplate that any suitable aerodynamically streamlined shape configured to improve fluid flow characteristics through the openings 607 and to reduce bubble trapping and electrolyte fluid retention on the substrate and contact ring are within the principles of the invention.

FIG. 6(*e*) is a drawing of a contact ring 650 according to a second embodiment of the present invention. This embodiment is substantially similar to the embodiment shown in FIGS. 6(*a*)–6(*d*), with the exception of opening 620, which has a substantially semi-circular cross-section (as opposed to the substantially rectangular cross-section shown in FIGS. 6(*a*)–6(*d*).

By improving the aerodynamic/hydrodynamic shape at cross-section C—C, many of the problems discussed in the Background section above are reduced or eliminated. Specifically, improved fluid flow reduces the propensity for trapped air during electroplating and trapped electrolyte during post plating cleaning operations. Additionally, improved fluid flow reduces the problem of localized boundary conditions to eliminate/minimize increased local plating rate.

Further, the incorporation of openings 607 allows easy electrolyte drainage around the contact ring during post-deplating processes and post-plating drying processes. Thus, extended high speed spinning in order to remove residual electrolyte can be eliminated from the process if desired, allowing for quick drying of the contact ring and improving plating operation throughput as well as eliminating or minimizing scalloping and electrolyte induced staining defects.

FIG. 6(*d*) is a cutaway view of a cross-section of contact ring 600 along a B—B cross-section line shown above in FIG. 6(*b*). Contact electrode 601 is shown supported by toroidal contact ring base 603. When viewed along the C—C cross-section, toroidal support structure 605 surrounds openings 607 (indicated by dashed lines). The view in FIG. 6(*d*) indicates that toroidal contact ring base 603 has a sloped cross-section along the C—C cross-section line. According to one embodiment of the invention, the shape of the C—C cross-section is chosen to improve electrolyte drainage due to gravity by providing a sloped surface, thus enabling electrolyte to flow downhill.

As noted above, it is important that contact rings be physically and chemically robust in order to provide proper support for a substrate and in order to minimize chemical wear and tear. Suitable contact ring materials can include, but are not limited to stainless steel at the core of the contact ring base. Additionally, the contact ring can be made more resistant to chemical effects by using a robust coating, one non-limiting example of a suitable material comprises Teflon® or Haylar® protective coating to increase chemical robustness. As is known to those having ordinary skill in the art many other suitable materials can also be employed, including any other chemically (acid, base, organic solvent) resistant coating. The metal contacts can be made out of a number of conductive materials. Particularly, suitable are refractory metal contacts protruding out of the protective coating. For example, Pt, Pd, Au, and Os contacts are satisfactory, although the invention is not limited to such. Additionally, W, Mo, Nb, Ta, Re contacts are also believed to be suitable. Moreover, the inventors specifically point out that the invention is not limited to materials disclosed here. Contacts made of any suitably conductive and suitable robust materials (as known to those having ordinary skill in the art) are well suited to employment in accordance with the principles of the invention.

Various process conditions may be varied in order to optimize the resulting electroplating process. For instance, referring back to FIG. 1, wherein a support arm 101 is used to immerse a substrate 103 into electrolyte 107, varying the angle and speed of entry into the electrolyte can be useful in improving the quality of the electroplated layer.

Regarding immersion speed, it is desirable that the substrate enter the electrolyte at a high rate of speed. Specifically, useful run rates (entry speeds) range broadly between about 50 mm/sec–200 mm/sec. In one implementation, a substrate is introduced into the electrolyte at 90 mm/sec. Also important is the rate of acceleration and deceleration. It is desirable that the substrate accelerate rapidly to full speed such that it enters the electrolyte at the proper speed and that it decelerate quickly and smoothly in order to minimize bubble formation on the surface of the substrate. Thus, the run rates listed above are run rates at immersion.

As mentioned above, the immersion entry angle may be optimized as well as the immersion angle. Optimal entry angles range broadly from 2–30°, and preferably from about 10–20°.

Figure 1:
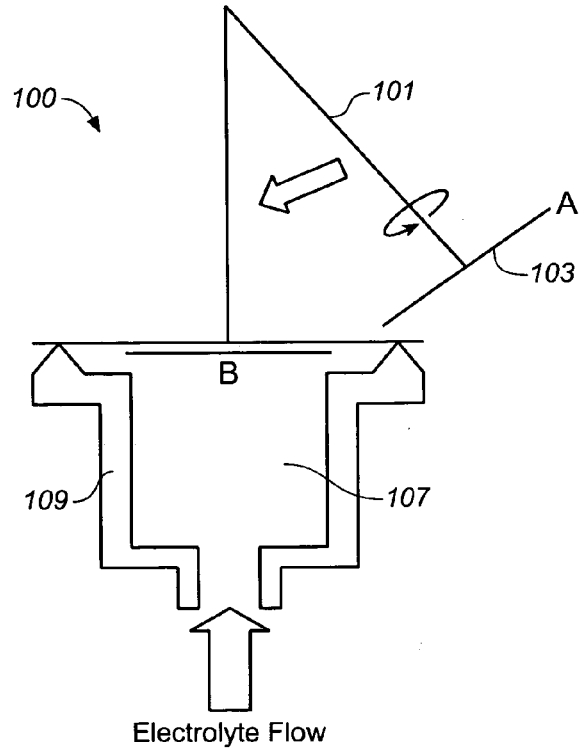
FIG. 1 is a schematic diagram of a side view of a conventional "fountain" type electroplating cell.
Figure 3:
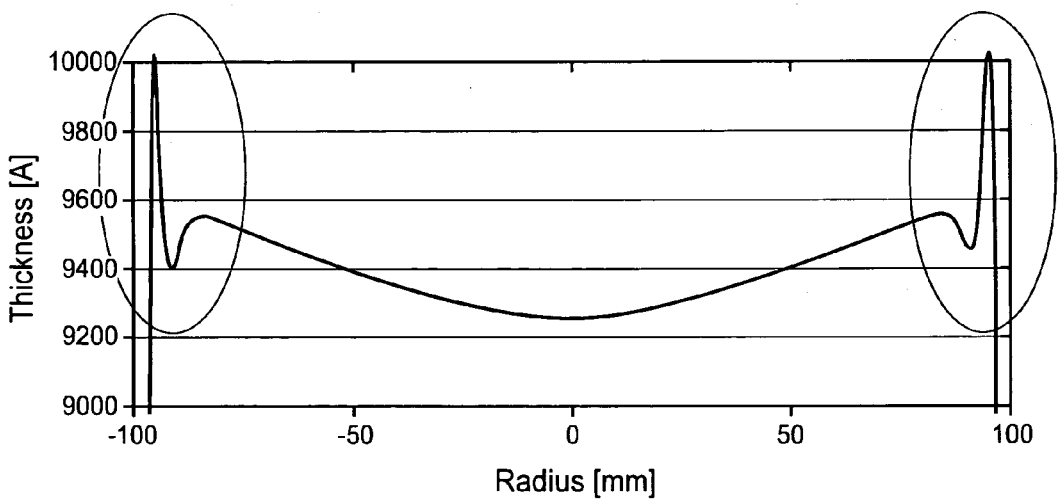
FIG. 3 is a graph of a thickness profile across the diameter of a semiconductor wafer, illustrating the impact of stagnation points due to fluid boundary conditions.
Figure 2A:
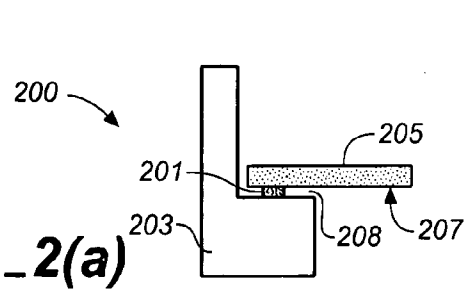
FIGS. 2(*a*) through 2(*f*) depict sectional and radial views of various conventional contact ring designs.
Figure 2B:
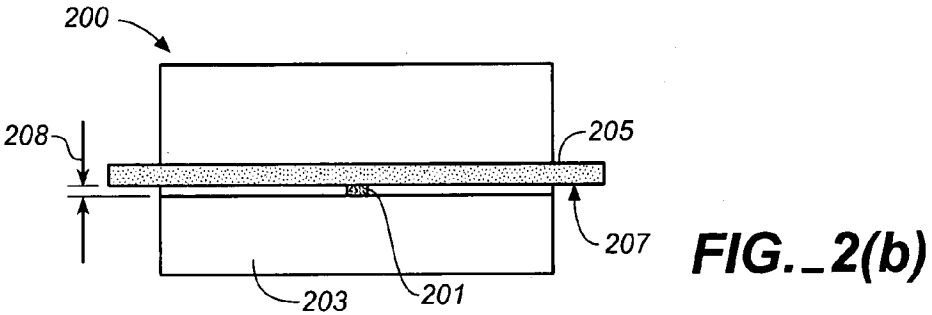
Figure 2C:
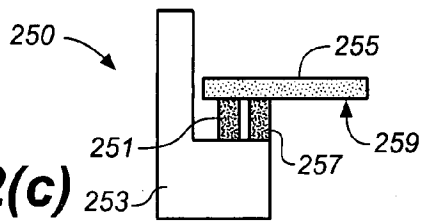
Figure 2D:
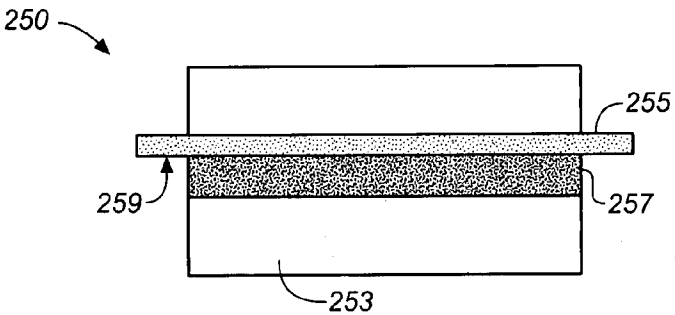
Figure 2E:
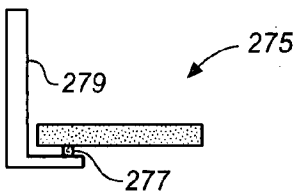
Figure 2F:
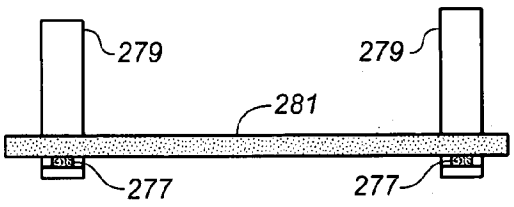
Figure 4A:
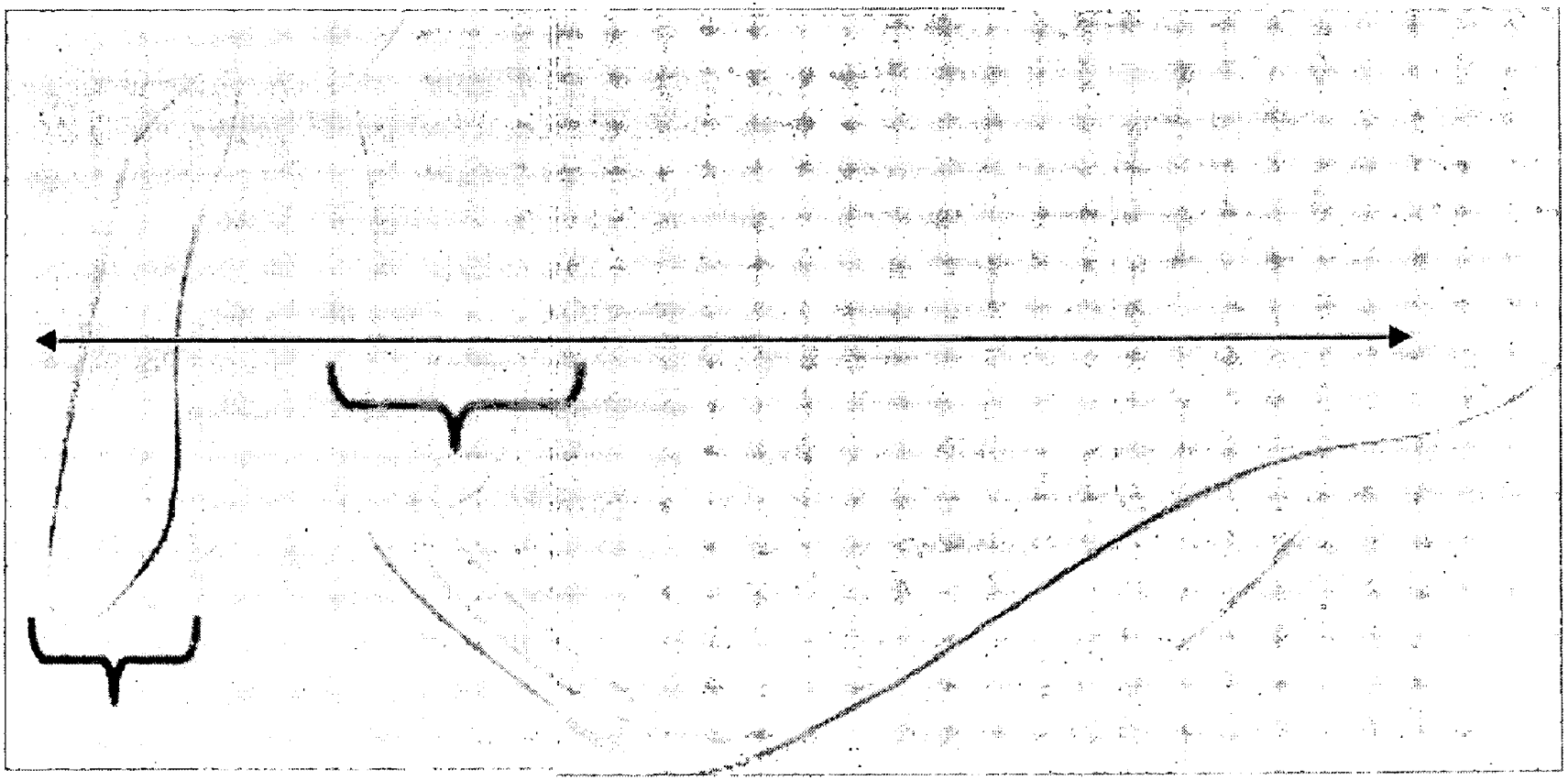
FIGS. 4(*a*) and 4(*b*) depict scalloping defects with FIG. 4(*a*) being a photograph of a "scalloping" defect and FIG. 4(*b*) showing an atomic force microscopy (AFM) scan of the scalloping defect.
Figure 4B:
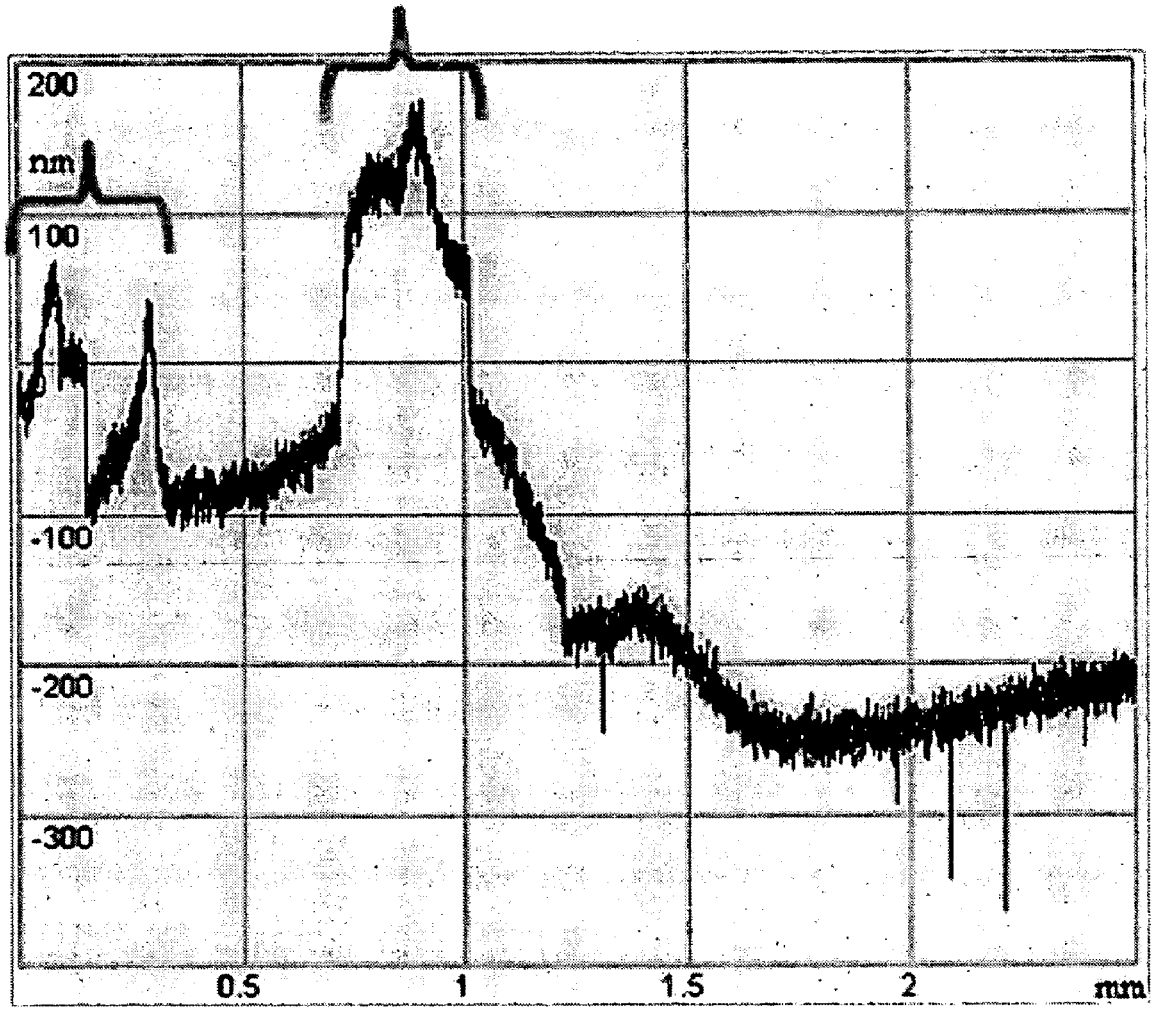

During electroplating, the support arm typically rotates as shown in FIG. 1. This immersion rotation rate may be varied as well to improve electroplating operations, with rotation rate in the range of about 10 to 200 RPM, preferably in the range of about 20–80 RPM.

Finally, the support arm is used to rotate a substrate to aid in cleaning operations after the substrate has been removed from the electrolyte. In one embodiment of the present invention, the substrate is rotated at a 100–1000 RPM in order to remove residual electrolytes, as described above in reference to FIG. 6(*c*). In preferred embodiments, the substrate is rotated at between 400–600 RPM. In order to maximize throughput, the rotation lasts less than about 10 seconds according to some embodiments of the invention.

While this invention has been described in terms of certain embodiments, there are various alterations, modifications, permutations, and substitute equivalents, which fall within the scope of this invention. It should also be noted that there are many alternative ways of implementing the methods and apparatuses of the present invention. Further, there are numerous applications of the present invention, both inside and outside the integrated circuit fabrication arena. Accordingly, the present embodiments are to be considered as illustrative and not restrictive, and the invention is not to be limited to the details given herein, but may be modified within the scope and equivalents of the appended claims. It is therefore intended that the following appended claims be interpreted as including all such alterations, modifications, permutations, and substitute equivalents as fall within the true spirit and scope of the present invention.

The invention claimed is:

1. A contact ring for use in electroplating of semiconductor substrates, comprising:

a toroidal support ring configured to allow fluid to flow radially away from the axis of the toroidal support ring and to prevent the trapping of fluids between the substrate and the toroidal support ring; and a plurality of electrodes arranged to support and electrically contact a substrate, which has been placed over the electrodes.

2. The contact ring of claim 1, wherein the toroidal support ring further comprises a plurality of aerodynamically streamlined flow surfaces.

3. The contact ring of claim 2, wherein the toroidal support ring further includes a plurality of openings formed in the toroidal support ring adjacent to the electrodes wherein the plurality of openings are configured to facilitate flow of bubbles and fluid away from the substrate and support ring through the openings.

4. The contact ring of claim 2, wherein each of the plurality of electrodes is located on an aerodynamically streamlined flow surface.

5. The contact ring of claim 2, wherein each of the plurality of electrodes is placed on an aerodynamically streamlined flow surface such that fluid may flow along the aerodynamically streamlined surface and around each electrode.

6. The contact ring of claim 2, wherein the cross-section of at least one of the aerodynamically streamlined flow surfaces in each opening is shaped like a wing.

7. The contact ring of claim 2, wherein the cross-section of at least one of the aerodynamically streamlined flow surfaces is elliptical.

8. The contact ring of claim 1, wherein the toroidal support ring further includes a plurality of openings formed in the toroidal support ring adjacent to the electrodes wherein the plurality of openings are configured to facilitate flow of bubbles and fluid away from the substrate and support ring through the openings.

9. The contact ring of claim 1, wherein the cross-section of each of the plurality of electrodes is elliptical.

10. A toroidal contact ring for use in electroplating of semiconductor wafers, comprising:

a contact ring base with sloped sides, configured to facilitate fluid flow over the ring base;

a support ring formed on and attached to the contact ring base;

a plurality of openings arranged along the circumference of the support ring, wherein each opening is configured to permit fluids to flow through the support ring radially from the inner edge of the ring to the outer edge of the ring and wherein each opening is shaped to reduce turbulence in fluids passing through the opening; and a plurality of electrodes arranged to support and electrically contact a substrate, which has been placed over the top of the support ring, wherein each electrode is placed in a fluid flow path of an opening.

11. The toroidal contact ring of claim 10 wherein the toroidal contact ring is configured to allow fluid flow radially away from the axis of the contact ring.

12. The toroidal contact ring of claim 10 wherein the toroidal contact ring is configured to aid gravity to drain a fluid from the surface of the contact ring.

13. The toroidal contact ring of claim 10, wherein each of the plurality of openings further comprises at least one aerodynamically streamlined flow surface.

14. The toroidal contact ring of claim 10, wherein the contact ring base comprises at least one aerodynamically streamlined flow surface.

15. The toroidal contact ring of claim 10, wherein each electrode is placed on an aerodynamically shaped flow surface such that fluid may flow along the aerodynamically streamlined surface and around each electrode.

16. The toroidal contact ring of claim 10, wherein the cross-section of each electrode is semi-circular.

17. The toroidal contact ring of claim 10, wherein each electrode is placed so as to minimize the trapping of fluids between the substrate and the toroidal contact ring.

18. A method of electroplating a substrate, comprising:

affixing a substrate to a toroidal contact ring which is connected to a support arm and a power supply, wherein the substrate is electrically as well as physically connected to the contact ring, and wherein where the contact ring comprises a plurality of openings arranged along the circumference of the support ring, wherein each opening is configured to permit fluids to flow through the support ring radially from the inner edge of the ring to the outer edge of the ring and wherein each opening is shaped to reduce turbulence in fluids passing through the opening to facilitate fluid flow through the ring;

immersing the contact ring into an electrolyte;

supplying a voltage to the substrate so as to allow an electroplating reaction to proceed;

rotating the immersed substrate at between about 10 to 200 RPM during electroplating;

removing the substrate from the electrolyte; and cleaning the substrate and contact ring by removing excess electrolyte from the rotating the immersed substrate at 100–1000 RPM for no more than 10 seconds.

19. The method of claim 18, wherein immersing the contact ring into an electrolyte comprises immersing the contact ring at an entry angle relative to the surface of the electrolyte of between about 2–30°.

20. The method of claim 19, wherein the entry angle is between about 10–20°.

21. The method of claim 18, wherein the rotation speed during immersion is 20–80 RPM.

22. The method of claim 18, wherein the rotation speed during cleaning is 400–600 RPM.

* * * * *